US006351902B1

(12) United States Patent
Yeung et al.

(10) Patent No.: US 6,351,902 B1
(45) Date of Patent: Mar. 5, 2002

(54) ELECTROTHERMAL IRONING BOARD

(76) Inventors: On Wa Yeung; Chiu Man Yeung, both of 6E, 35/F., Greenfield Garden, Tsing Yi (HK)

( * ) Notice: Subject to any disclaimer, the term of this patent is extended or adjusted under 35 U.S.C. 154(b) by 0 days.

(21) Appl. No.: 09/621,261

(22) Filed: Jan. 5, 2001

(30) Foreign Application Priority Data

Dec. 1, 1999 (CN) ..... 99 2 46461

(51) Int. Cl.[7] ..... D06F 83/00
(52) U.S. Cl. ..... 38/140
(58) Field of Search ..... 38/66, 137, 140; 219/528, 529, 548, 553

(56) References Cited

U.S. PATENT DOCUMENTS 2,249,110 A * 7/1941 Browning ..... 38/137
2,282,300 A * 5/1942 Place ..... 38/137
2,527,363 A * 10/1950 Jacowitz ..... 38/137
2,703,775 A * 3/1955 Panagrossi et al. ..... 38/140
3,206,881 A * 9/1965 Kleinsorge ..... 38/137
4,484,400 A * 11/1984 Lehrman ..... 38/140

FOREIGN PATENT DOCUMENTS

GB 752473 * 3/1954 ..... 38/137
GB 2272226 * 5/1994 ..... 38/93

* cited by examiner

*Primary Examiner*—Ismael Izaguirre
(74) *Attorney, Agent, or Firm*—Clark & Elbing, LLP

(57) ABSTRACT

This invention discloses an electrothermal ironing board, comprising a holding plate, a sponge plastics, heat-resistant insulating cloths, an electric film with metal electrodes and a cloth cover, all of which are uniform thin layers, the heating element being the electric film, disposed in order from bottom to top being the holding plate, the plastic foam, the lower heat-resistant insulating cloth, the electric film with the metal electrodes, the upper heat-resistant insulating cloth and the cloth cover; and the circuit of the ironing board comprising the electric film, the metal electrodes and a thermal switch.

8 Claims, 1 Drawing Sheet

ELECTROTHERMAL IRONING BOARD

FIELD OF THE INVENTION

The present invention relates to an ironing board, and particularly to an electrothermal ironing board.

BACKGROUND OF THE INVENTION

When ironing clothes, an iron which is heated and an ironing board which is not heated are commonly used. Ironing boards provided with heat-generating means are disclosed in U.S. Pat. No. 4,919,744, European Patent Application No. 882112545.4, Japanese Publication (A) Hei 1-310699, Japanese publication (A) Hei 5-184800 and so on. However, these ironing boards are complicated in structure, have a complex circuit, are difficult to manufacture and have a high production cost. An ironing board for ironing clothes provided with heat-generating means is needed which is simple in structure and has a simple circuit.

SUMMARY OF THE INVENTION

The object of the present invention is to provide an ironing board with heat-generating means, which is simple in structure and easy to manufacture.

To achieve the object of the invention, there is provided an ironing board, comprising a holding plate, a sponge plastics, heat-resistant insulating cloths, an electric film with metal electrodes and a cloth cover, all of which are uniform thin layers, the heating element being the electric film, disposed in order from bottom to top being the holding plate, the plastic foam, the lower heat-resistant insulating cloth, the electric film with the metal electrodes, the upper heat-resistant insulating cloth and the cloth cover; and the circuit of the ironing board comprising the electric film, the metal electrodes and a thermal switch.

The advantages of the invention lies in that: it has a simple structure and is easy to manufacture. Since the electric film is used as the heat-generating element, the circuit is very simple. And since a large area of the ironing board surface of the invention is heated uniformly, it will be more convenient, effective and safe to iron clothes.

BRIEF DESCRIPTION OF THE ACCOMPANYING DRAWINGS

The embodiments of the invention will be described in detail in connection with the accompanying drawings in which.

DETAILED DESCRIPTION OF THE PREFERRED EMBODIMENTS

Figure 1:
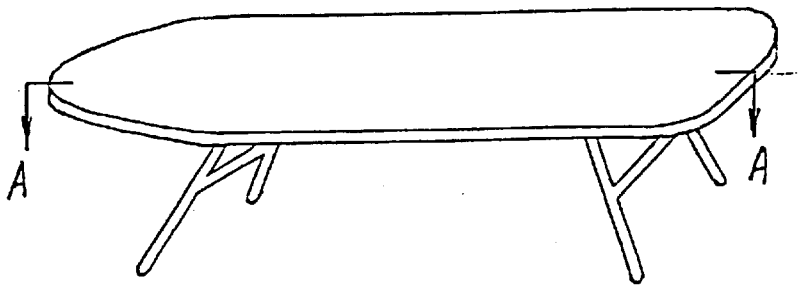
FIG. 1 is a perspective view showing the construction of an electrothermal ironing board in accordance with the invention.

Reference is now made to FIG. 1, which is a perspective view showing the construction of the electrothermal ironing board in accordance with the invention. So far as the outline is concerned, it has no difference from conventional ironing boards. But the entire upper surface of the ironing board of the invention are uniformly electrically heated and thus can be used to iron clothes; and the associated iron can be one that is not electrically heated and wireless. Since the iron no longer needs to be electrically heated, it is wireless and is more convenient and safer to use. The height of the support of the ironing board can be adjusted, and can be foldable or non-foldable.

Figure 2:
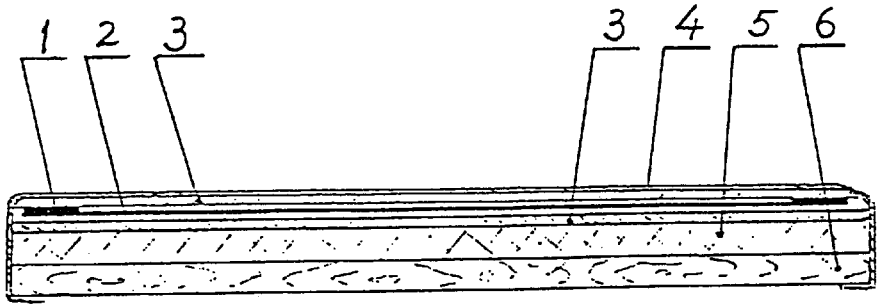
FIG. 2 is a sectional view of the ironing board taken along line A—A in FIG. 1.

Referring to FIG. 2, which is a sectional view taken along line A—A in FIG. 1. There is clearly shown in the figure the structure of the ironing board of the invention. As shown in FIG. 2, at the bottom thereof there is provided a holding plate 6 which can be made of plank and has a flat top surface. Disposed on the holding plate 6 is a sponge plastics 5 which is an uniform thin layer, with such a layer of sponge plastics, the ironing board does not feel too hard and has a comfortable feel; and concurrently, the sponge plastics functions as a thermal insulation layer to prevent heat from transferring downwards. Disposed on the thin sponge plastics layer are two layers of heat-resistant insulating cloth 3 one on top of the other, and between the two layers of heat-resistant insulating cloth there is arranged a cloth-like electric film with metal electrodes 1. The metal electrodes 1 are disposed at the two ends of the film 2 in a longitudinal direction of the film, and power lines to be connected to a AC power source are connected with the metal electrodes 1.

On the upper heat-resistant insulating cloth 3 there is covered a cloth cover 4 which, as in the conventional ironing board, wraps up the upper and side surfaces of the entire ironing board and is nailed on the bottom surface of the holding plate 6 around the edge of the ironing board.

That the ironing board is constituted by stacked layers or stacked cloth-like layers, each of which is a uniform thin one, is a characteristic of the invention. With such a structure, the ironing board is simple in structure and is easy to manufacture.

The heating element is the electric heating film 2, its resistance should be determined according to the working voltage and power. For example, for an exemplary ironing board of 0.5 m×0.1 m, the electric film 2 has a working area of about 500 $cm^2$, the resistance is 194 ohms under the conditions that the working voltage is 220 volts and the power is 250 watts. A practical electrothermal ironing board has a dimension of 1.0 m×0.3 m, and the electric film 2 has a working area of about 3,000 $cm^2$, the electric resistance is about 40 ohms when the working voltage is 220 volts and the power is 1200 watts. The designing procedure for the circuit is that: determining the working area of the electric film 2 (the heat producing capability being taken as 0.4–0.5 watts/$cm^2$) according to the size of the ironing board and the desired power; and then determining its overall resistance according to its working voltage and power. The overall resistance can be obtained by cutting the electric film into several pieces and properly connecting them in series and in parallel.

As the heating film, the electric film 2 can a conductive film of polymer material, such as polytetrafluoroethylene (Teflon).

The cloth cover can be made of cotton cloth.

Figure 3:
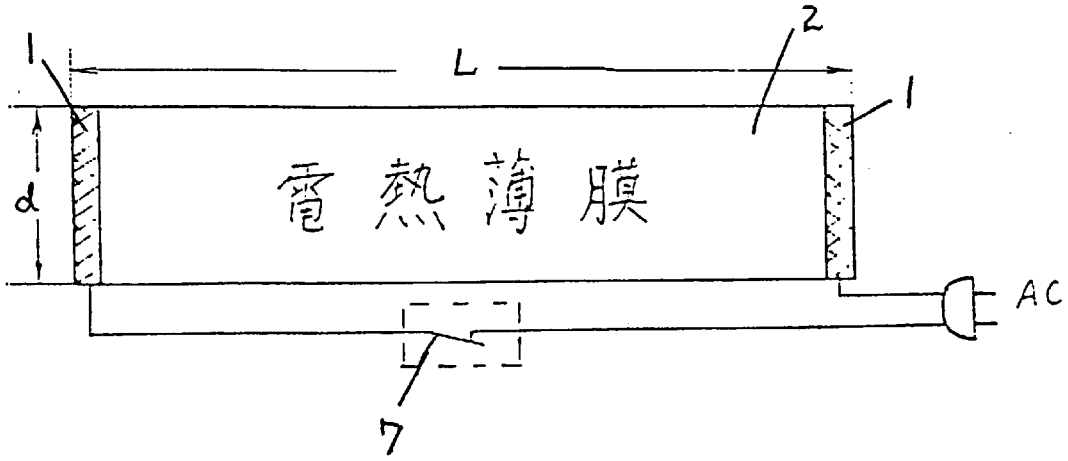
FIG. 3 is a circuit diagram used in the ironing board in accordance with the invention.

Referring to FIG. 3, which shows a circuit diagram used for the electric heating means of the ironing board. As shown in FIG. 3, the circuit is composed of an electric film 2 as a heating element, metal electrodes 1 and a thermal switch 7, in which the length of the electric film 2 is L, the width of the film is d; and the metal electrodes 1 are disposed at the two ends of the electric film in the longitudinal direction of the film. The metal electrodes may be thin metallic meshes or thin metallic films pressed onto the electric film 2 at both ends to form a parallel electrode arrangement. Such an arrangement can produce uniform electric field and electric current, with the result that the electric film can generate heat uniformly and the circuit has a simple structure.

The thermal switch 7 is provided in a power line leading from one electrode 1 to the power source, the thermal switch is a normally closed switch with a predetermined action (turn-off and turn-on) temperature. When the temperature of the electric film 2 is over the predetermined temperature, the thermal switch 7 is turned off to allow the electric film as the heating element to lower its temperature; and when the latter is below the predetermined turn-off temperature, the switch is turned on again. The above process is repeated until the ironing is finished. During the whole ironing process, the ironing temperature is maintained within an appropriate range so as to ensure safety. The thermal switch 7 can be one which has an action temperature of 120–175° C.

As to the sizes of L and d, L can be in the range of 0.5 to 1.2 m and d can be in the range of 10 to 40 cm. The electric resistance and size of the electric film 2 can be determined according to the voltage and power applicable.

The ironing board of the invention can be put into operation when being supplied with electricity, and will not move during the whole ironing process. Therefore, it is safe and reliable. The wireless and heatless "iron" used for pressing clothes can be made very compact and light. Without being heated and wire connected thereto, the iron can be manipulated by the users safely and conveniently. If a water-containing and spraying device is added to the wireless and heatless "iron", this novel ironing method will be more ideal.

In addition, since the ironing board generates heat over a large area, clothes are heated uniformly and local burns will not occur to the clothes during the ironing process, the invention will definitely pander to the need of people.

What is claimed is:

1. An electrothermal ironing board, comprising a holding plate, a plastic foam, heat-resistant insulating cloths, an electric film with metal electrodes, and a cloth cover, wherein all of which are uniform thin layers, the heating element being the electric film, disposed in order from bottom to top being the holding plate, the plastic foam, the lower heat-resistant insulating cloth, the electric film with the metal electrodes, the upper heat-resistant insulating cloth, and the cloth cover; and the circuit of the ironing board comprising the electric film, the metal electrodes, and a thermal switch.

2. The ironing board as claimed in claim 1, wherein the electric film is a conductive polymer film.

3. The ironing board as claimed in claim 2, wherein the conductive polymer film is conductive polytetrafluoroethylene (Teflon) film.

4. The ironing board as claimed in claim 1, wherein the conductive film (2) forms a circuit via the metal electrodes (1) and becomes the heating element.

5. The ironing board as claimed in claim 1 or 3, wherein the metal electrodes (1) are thin metallic meshes or thin metallic film pressed onto the electric film (2).

6. The ironing board as claimed in claim 1, wherein the electric film (2) ensures the smoothness of the surface of the ironing board and spreads over the entire ironing board in a single layer to generate heat uniformly.

7. The ironing board as claimed in claim 1, wherein the thermal switch functions to control the temperature and provide overheat protection, the action temperature of the thermal switch is between 120 and 175° C.

8. The ironing board as claimed in claim 1, wherein the electric film (2) generates 0.4–0.5 W/cm$^2$.

* * * * *